US006904617B2

(12) United States Patent
Tsai

(10) Patent No.: US 6,904,617 B2
(45) Date of Patent: Jun. 14, 2005

(54) THERMAL LINING

(76) Inventor: Lincoln Tsai, 3117 Adelia Ave., #32, El Monte, CA (US) 91733

( * ) Notice: Subject to any disclaimer, the term of this patent is extended or adjusted under 35 U.S.C. 154(b) by 42 days.

(21) Appl. No.: 10/178,093

(22) Filed: Jun. 25, 2002

(65) Prior Publication Data

US 2003/0233697 A1 Dec. 25, 2003

(51) Int. Cl.[7] ..... A42B 1/24
(52) U.S. Cl. ..... 2/209.13
(58) Field of Search ..... 2/209.13, 175.1, 2/195.1, 247; 607/108–111, 139–141

(56) References Cited

U.S. PATENT DOCUMENTS 4,133,055 A * 1/1979 Zebuhr ..... 2/411
4,484,363 A * 11/1984 Varanese ..... 2/209.13
5,197,292 A * 3/1993 McPherson ..... 62/56
5,327,585 A * 7/1994 Karlan ..... 2/7
5,557,807 A * 9/1996 Hujar et al. ..... 2/171.2
6,017,606 A * 1/2000 Sage et al. ..... 428/68
6,187,031 B1 * 2/2001 Douglas ..... 607/112

* cited by examiner

*Primary Examiner*—Katherine M Moran
(74) *Attorney, Agent, or Firm*—Raymond Y. Chan; David and Raymond

(57) ABSTRACT

A thermal lining includes a first layer, a second layer overlappedly attached to the first layer in an edge to edge manner to form a construction pocket between the first and second layers wherein the construction pocket is shaped and sized for receiving in a storage compartment of a wear, and a cooling agent, having water absorbing ability, disposed in the construction pocket to form a heat insulation layer between the first and second layers. Therefore, the wearer is able to soak the thermal lining into the water, in such a manner that the water is permeated through the first layer into the construction pocket and absorbed by the cooling agent therein. The cooling agent with the water absorbed therein is adapted for receiving heat energy and gradually releasing the heat energy by evaporating the water, so as to provide the cooling effect for the wearer.

2 Claims, 6 Drawing Sheets

THERMAL LINING

BACKGROUND OF THE PRESENT INVENTION

1. Field of Invention

The present invention relates to a heat insulating sportswear, and more particularly to a thermal lining for a wear, which provides not only good heat insulation but also cooling effect of the wear, such as cap, jacket, or even a bag, so as to avoid heat discomfort of a wearer.

2. Description of Related Arts

During outdoor activity, such as jogging, watching a ball game in a stadium, or even outdoor shopping, people usually expose under sunlight. It is known that heat is transferred to the human body such that people may feel discomfort. Therefore, people may try to wear a pale-colored shirt and a cap in order to lower the heat absorption and block the sunlight respectively. However, such clothing will absorb the heat after a period of time and often make the wearer sweat and feel uncomfortable.

For example, the cap has been broadly used and considered as a convenience tool for sun shading, wherein the cap generally comprises a cap body to cover a top portion of the wearer's head and a visor extended from the cap body for blocking the sunlight. Even though the cap body can prevent the wear's head directly exposing to the sun, the ventilation of the cap is poor and often make the wearer sweat and feel uncomfortable. Another type of the cap is purposely created to attempt to solve the above problem by leaving the top portion of the cap body open so as to provide good ventilation on top of the wearer's head. However, the wearer's head will expose to the sunlight and raise the temperature of the wearer's head after a period of time.

Another example illustrates that an improved cap incorporated with a cooling pad to provide a cooling effect for the wearer, wherein the cooling pad, such as an ice pad, is attached to an inner side of the cap body so as to directly cool down the wearer's head. Usually, the cooling pad must be placed in a refrigerator to make the cooling pad in an icy manner. However, due to the sunlight, the cooling pad inside the cap will create a moist layer on the cooling pad in such a manner that the cap will get wet and discomfort the wearer. Especially when the cooling pad is used in a bag for keeping an object inside the bag cool, the moist layer will not only damage the object inside the bag but also wet the bag surface. Thus, the cooling pad must be treated before it is used, such as placing the cooling pad in the refrigerator. However, the cooling effect of the cooling pad cannot be last long.

SUMMARY OF THE PRESENT INVENTION

A main object of the present invention is to provide a thermal lining for a wear, which provides not only good heat insulation but also cooling effect for the wearer, so as to avoid heat discomfort of the wearer.

Another object of the present invention is to provide a thermal lining for a wear, wherein the thermal lining comprises a cooling agent having a water-absorbing ability detachably placed in a storage compartment of the wear. Therefore, the heat from the sunlight will be absorbed by the cooling agent so as to keep the wearer' body cool.

Another object of the present invention is to provide a thermal lining for a wear, which is easy and safe to use. The wearer can simply soak the thermal lining into an ice water or cool water in order to let the cooling agent absorbing the water and then put the thermal lining inside the wear. The water absorbed by the cooling agent will be gradually evaporated corresponding to the heat intensity of the sunlight, so as to provide a cooling effect for the wearer.

Another object of the present invention is to provide a thermal lining for a wear, wherein the thermal lining is remained in a dry condition after soaking into the ice water and no moist layer is created by the cooling agent during evaporation. Therefore, the wear is free from moisture, so as to prevent the wear getting wet by the thermal lining.

Another object of the present invention is to provide a thermal lining for a wear, wherein the thermal lining can be shaped and sized to fit any shape of the wear having a storage compartment. In other words, the thermal lining is adapted to incorporate with a cap, jacket, or even a bag so as to provide the cooling effect for the wear.

Another object of the present invention is to provide a thermal lining for a wear, wherein the cooling agent is reusable such that the wearer is able to soak the thermal lining back to the water after the water absorbed by the cooling agent is evaporated.

Accordingly, in order to accomplish the above objects, the present invention provides a thermal lining for a wear which comprises a storage compartment, wherein the thermal lining comprises:

a first layer made of fabric adapted for water permeating therethrough;

a second layer overlappedly attached to the first layer in an edge to edge manner to form a construction pocket between the first and second layers wherein the construction pocket is shaped and sized for receiving in the storage compartment of the wear; and a cooling agent, having water absorbing ability, disposed in the construction pocket to form a heat insulation layer between the first and second layers wherein the cooling agent is adapted for absorbing and retaining the water and releasing the water by evaporation, so as to provide a cooling effect of the wear.

Therefore, the wearer is able to soak the thermal lining into the water, in such a manner that the water is permeated through the first layer into the construction pocket and absorbed by the cooling agent therein. The cooling agent with the water absorbed therein is adapted for receiving heat energy and gradually releasing the heat energy by evaporating the water, so as to provide the cooling effect for the wearer.

The present invention further provides a method of manufacturing the thermal lining, which comprises the steps of:

(a) cutting the first and second layers into a predetermined shape;

(b) overlappedly attaching the first and second layers in an edge to edge manner to form the construction pocket while one edge of the construction pocket is remained unattached to form an opening of the construction pocket;

(c) disposing a predetermined amount of solid cooling agent into the construction pocket through the opening, wherein the solid cooling agent is adapted for absorbing water to form the liquid form heat insulation layer so as to expand a size of the cooling agent; and (d) sealedly enclosing the construction pocket by sewing the opening, wherein the construction pocket is shaped and sized to hold and retain the cooling agent after the cooling agent is expanded.

DETAILED DESCRIPTION OF THE PREFERRED EMBODIMENT

Figure 1:
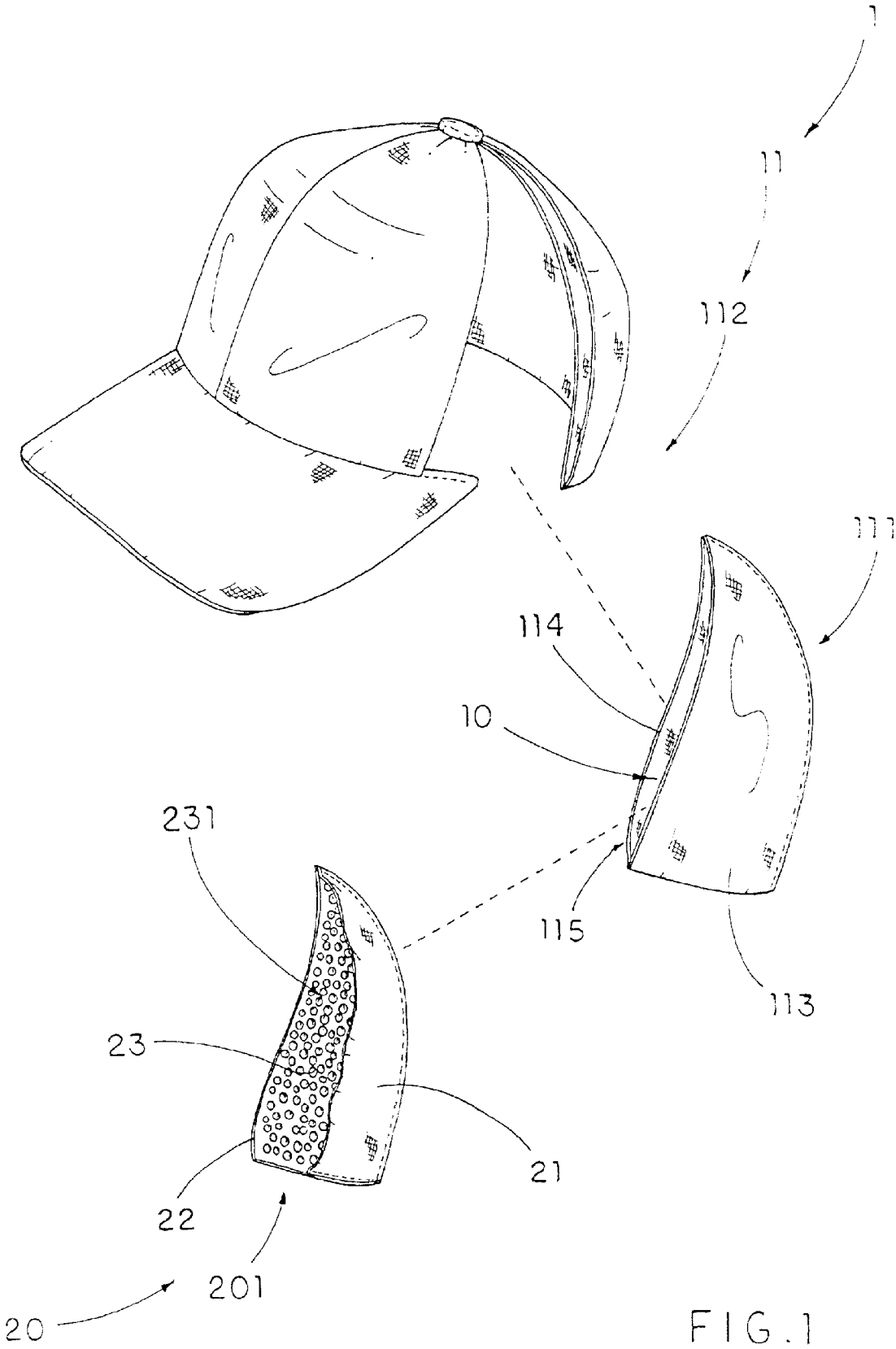
FIG. 1 is an exploded perspective view of a thermal lining incorporated with a cap according to a first preferred embodiment of the present invention.
Figure 2:
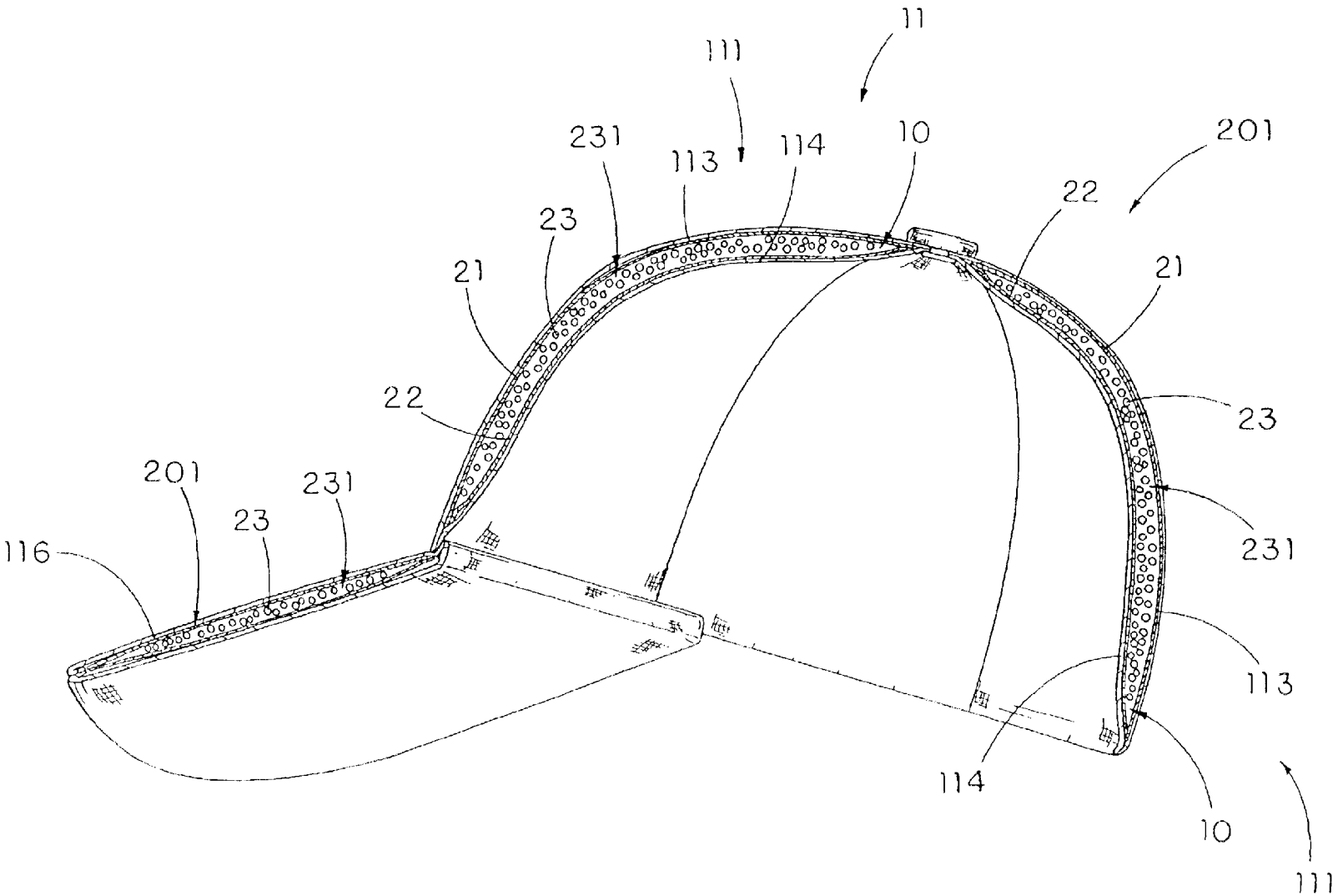
FIG. 2 is a sectional view of the cap with the thermal lining disposed in the cap according to the above preferred embodiment of the present invention.

Referring to FIGS. 1 and 2 of the drawings, a thermal lining 20 incorporated with a wear 1 having a storage compartment 10 according to a preferred embodiment of the present invention is illustrated, wherein the thermal lining 20 is adapted for detachably receiving in the storage compartment 10 of the wear 1.

The thermal lining 20 comprises a first layer 21 made of fabric adapted for water permeating therethrough, a second layer 22 overlappedly attached to the first layer 21 in an edge to edge manner to form a construction pocket 201 between the first and second layers 21, 22 wherein the construction pocket 201 is shaped and sized for receiving in the storage compartment 10 of the wear 1, and a cooling agent 23, having water absorbing ability, disposed in the construction pocket 201 to form a heat insulation layer 231 between the first and second layers 21, 22 wherein the cooling agent 23 is adapted for absorbing and retaining the water therein and releasing the water by evaporation, so as to provide a cooling effect of the wear 1.

According to the preferred embodiment, the wear 1 is embodied as a cap 11 to incorporate with the thermal lining 20, wherein the cap 11 generally comprises a plurality of cap leaves 111 attached edge with edge together to form a cap body 112. The storage compartment 10 is formed at each of the cap leaves 111 by overlappingly attaching an outer layer 113 and an inner layer 114 together so as to define an inlet opening 115 at one edge of the cap leave 111 for communicating the storage compartment 10 with outside.

The first and second layers 21, 22 are preferred made of fabric having ventilating properties and durability because the first and second layers 21, 22 are adapted for water permeating into the construction pocket 201 and retaining a shape of the cooling agent 23 in the construction pocket 201.

The cooling agent 23, according to the preferred embodiment, is made of resin wherein the cooling agent 23 is capable of absorbing a relatively large amount of water. After absorbing the water, the cooling agent 23 expends its size in order to keep the amount of water therein. Even though a pressure is applied on the cooling agent 23, the water will not be released from the cooling agent 23. In other words, after the cooling agent 23 absorbs the water, the thermal lining 20 is still remained in a dry condition.

Before the cooling agent 23 absorbs the water, the cooling agent 23 is in a solid phase, preferred in a granular shaped. However, after soaking with the water, the cooling agent 23 expands its size and changes its phase from solid from liquid such as gel form, so as to form the heat insulation layer 231. It is worth to mention that the construction pocket 201 is shaped and sized to fit the cooling agent 23 after water absorption so as to retain the gel form cooling agent 23 between the first and second layers 21, 22. Moreover, only water is capable of permeating through the first and second layers 21, 22, the cooling agent 23 will be kept in the construction pocket 201 without leaking therefrom.

Figure 3:
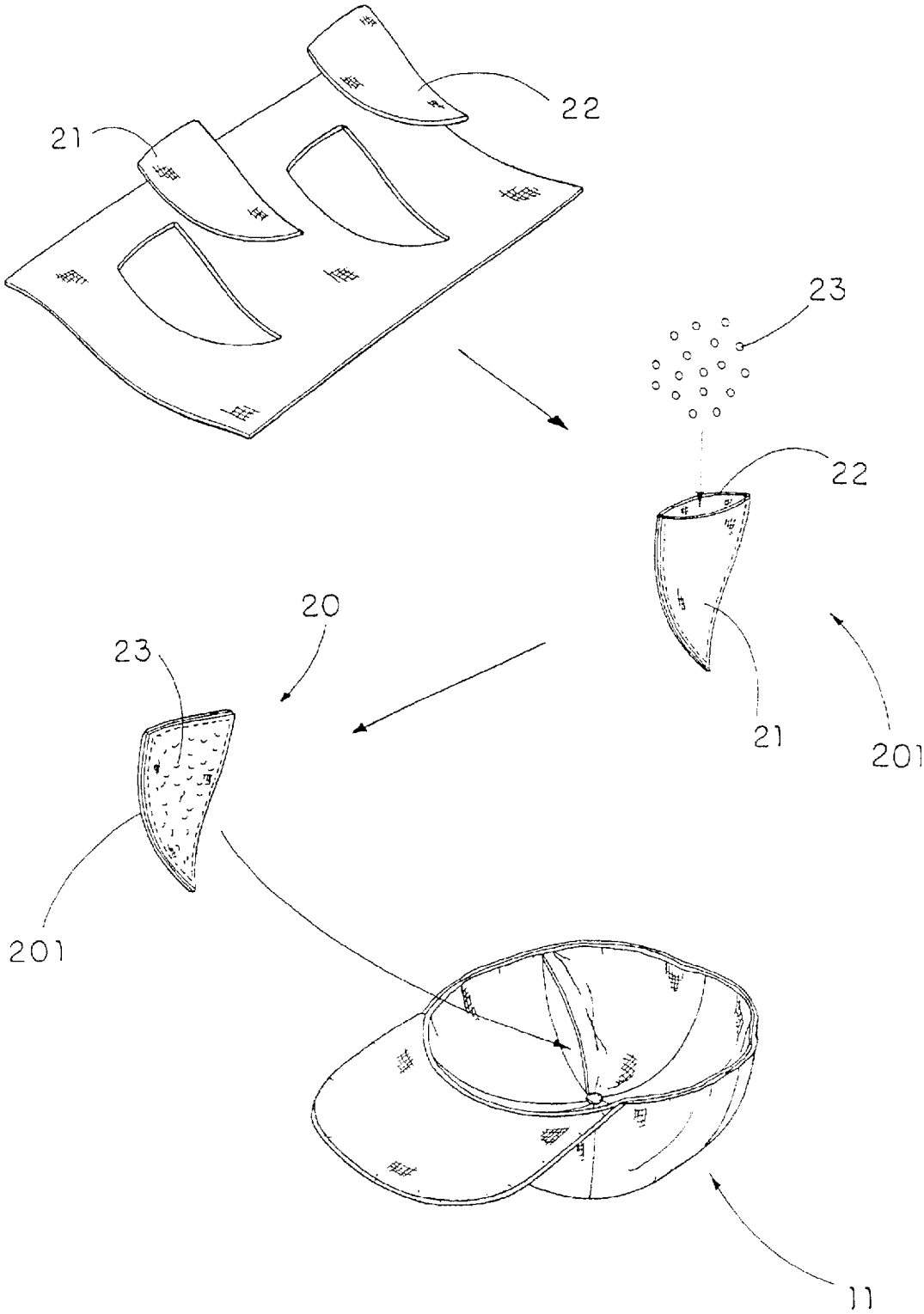
FIG. 3 illustrates a method of manufacturing the thermal lining according to the above preferred embodiment of the present invention.

As shown in FIG. 3, a method of manufacturing the thermal lining 20 comprises the following steps.

(1) Cut the first and second layers 21, 22 into a predetermined shape.

(2) Overlappedly attach the first and second layers 21, 22 in an edge to edge manner to form the construction pocket 201 while one edge of the construction pocket 201 is remained unattached to form an opening of the construction pocket 201.

(3) Dispose a predetermined amount of solid cooling agent 23 into the construction pocket 201 through the opening, wherein the solid cooling agent 23 is adapted for absorbing water to form the liquid form heat insulation layer 231 so as to expand a size of the cooling agent 23.

(4) Sealedly enclose the construction pocket 201 by sewing the opening, wherein the construction pocket 201 is shaped and sized to hold and retain the cooling agent 23 after the cooling agent 23 is expanded.

In step (1), the construction pocket 201 is adapted to be formed by overlapping a piece of fabric in half to define the first and second layers 21, 22 and attaching two edges thereof to form the opening at the remaining edge of the construction pocket 201.

Figure 4:
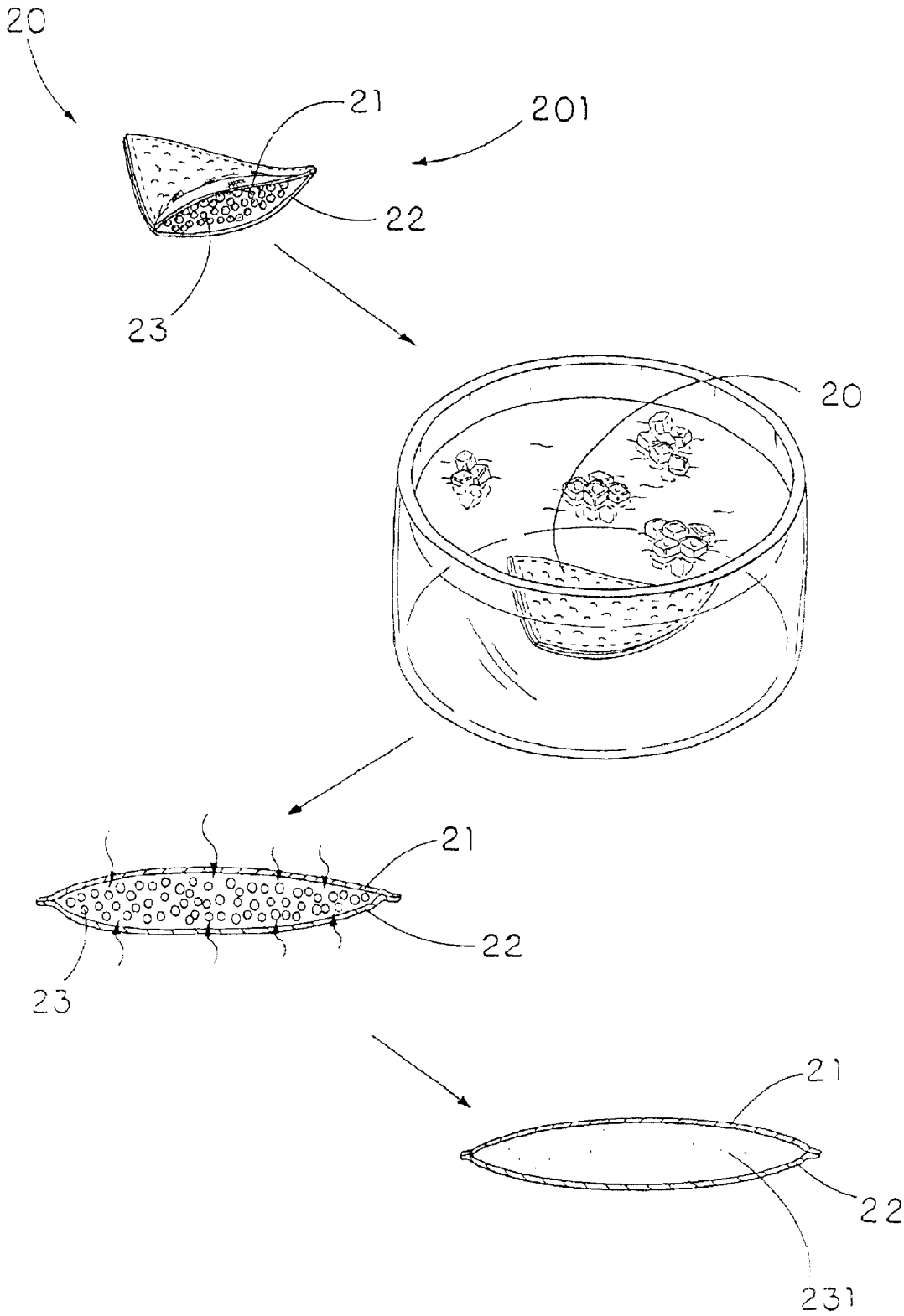
FIG. 4 illustrates a method of using the thermal lining for the cap according to the above preferred embodiment of the present invention.

In order to incorporate the thermal lining 20 with the cap 11, the wearer must soak the thermal lining 20 with a water, preferred ice water. Then, the water will permeate through the first and second layers 21, 22 into the construction pocket 201 wherein the cooling agent 23 will absorb the water and change the phase from solid to liquid so as to form the heat insulation layer 231 of the thermal lining 20. Therefore, the wearer is able to place the thermal lining 20 into the storage compartment 10 of the cap 11 for providing a cooling effect for the wearer, as shown in FIG. 4. It is worth to mention that the liquid form heat insulation layer 231 not only can be deformed to a shape to fit in the storage compartment 10 and but also will provide a softy cushion effect for the cap 11.

While the ambient temperature is increasing, such as exposing under the sunlight, the heat insulation layer 231 of the thermal lining 20 will absorb the heat energy. On the other hand, the heat insulation layer 231 will start to release the heat energy by evaporating the water absorbed in the cooling agent 23 wherein no moist layer is created by the cooling agent 23 during evaporation so that the cap is free from moisture. As a result, no heat is transferred to the wearer's head so as to avoid heat discomfort of the wearer. Thus, the water in the cooling agent 23 is evaporated to provide a ventilating and cooling effect of the cap 11 so as to keep the wearer's head cool. It is worth to mention that since the thermal lining 20 is detachably disposed in the storage compartment 10, when the water in the cooling agent 23 is evaporated, the cooling agent 23 will change its phase back from the liquid phase to the solid phase. Therefore, the wearer is able to re-use the thermal lining 20 by simply soaking the thermal lining 20 back to the water.

Figure 5:
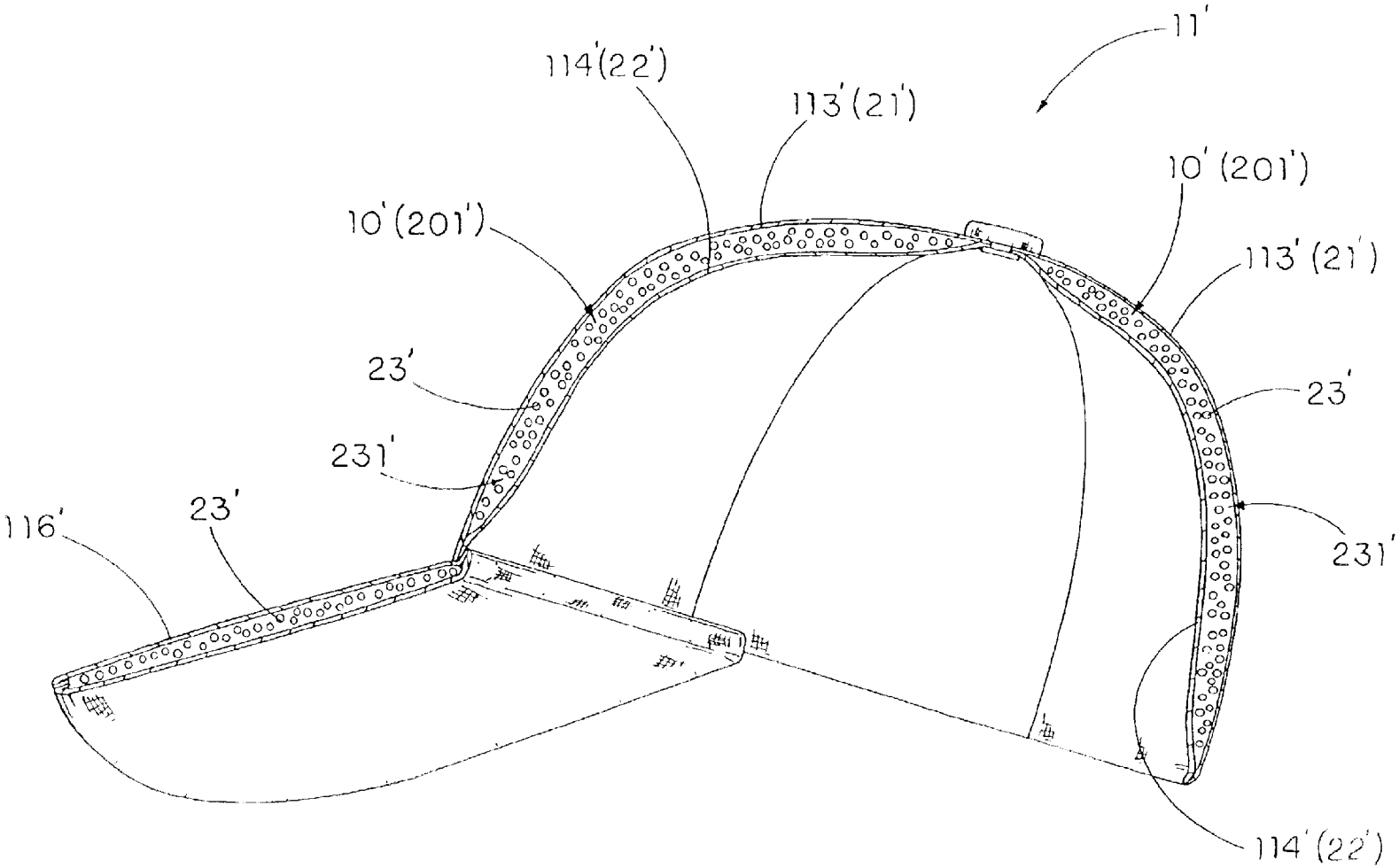
FIG. 5 illustrates an alternative mode of a construction pocket of the thermal lining according to the above preferred embodiment of the present invention.

FIG. 5 illustrates an alternative mode of the construction pocket 201' wherein the first layer 21' is integrally and overlappedly attached to the outer layer 113' and the second layer 22' is integrally and overlappedly attached to the inner layer 114' so as to form the construction pocket 201', i.e. the storage compartment 10' of the cap 11', between the outer layer 113' and the inner layer 114', so as to receive the cooling agent 23' therebetween. In other words, the heat insulation layer 231' is integrally built-in with the cap body 112'. It is worth to mention that the heat insulation layer 231' is adapted to provide at a visor 116, 116' of the cap 11, 11' in order to enhance the cooling effect of the cap 11, 11', as shown in FIGS. 2 and 5.

Figure 6:
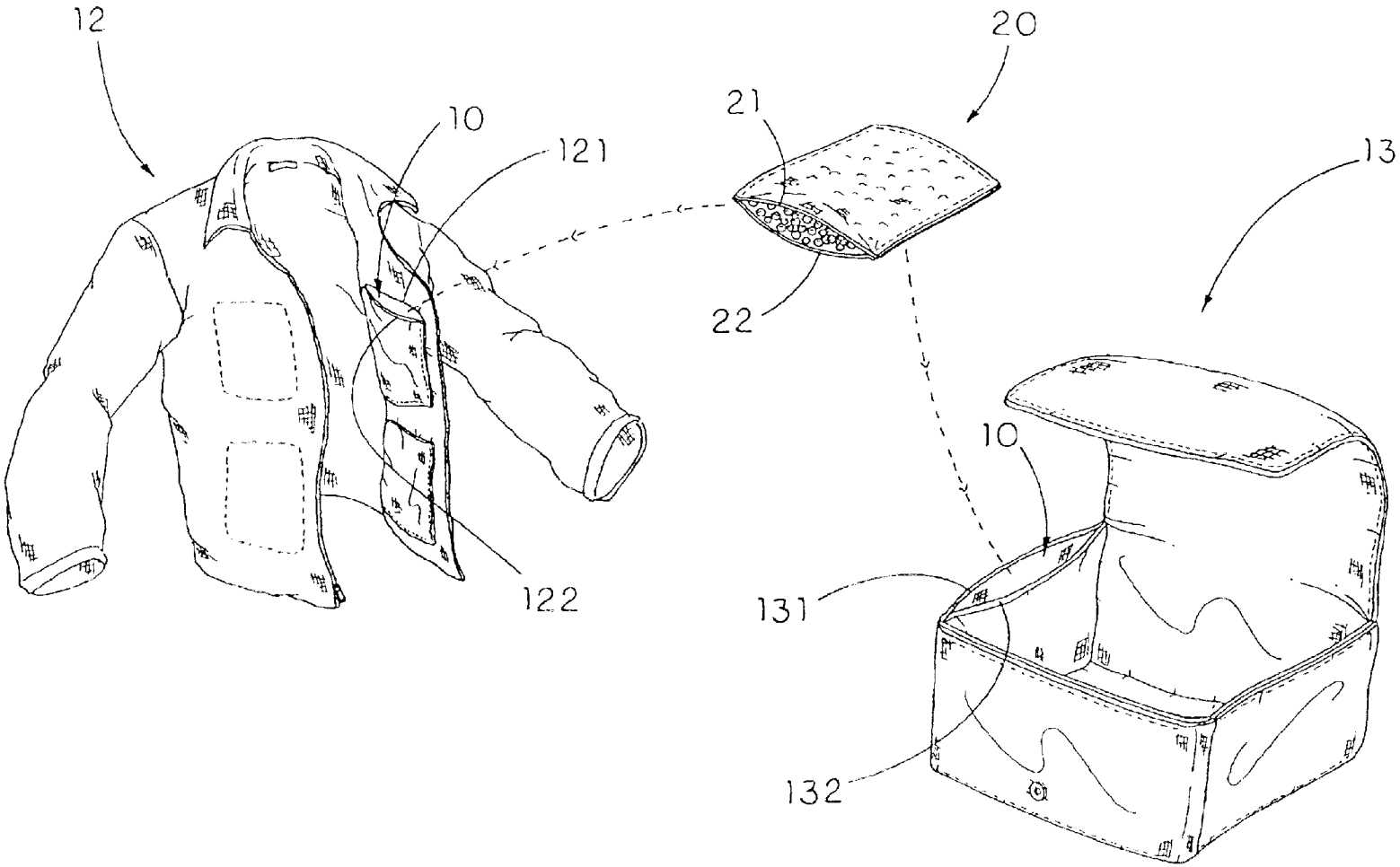
FIG. 6 illustrate the applications of the thermal lining according to the above preferred embodiment of the present invention, illustrating the thermal lining adapted for incorporating with a jacket and a bag.

As shown in FIG. 6, the thermal lining 20, according to the preferred embodiment, is incorporated with the wear 10 such as jacket 12 or bag 13. Accordingly, the jacket 12 comprises an outer layer 121 and an inner layer 122 overlapped with the outer layer 121 to form the storage compartment 10 therebetween wherein the thermal lining 20 is received in the storage compartment 10.

Similarly, the bag 13 comprises an outer layer 131 and an inner layer 132 overlapped with the outer layer 131 to form the storage compartment 10 therebetween to receive the thermal lining 20. It is worth to mention that thermal lining 20 is adapted to be built-in to the jacket 12 and/or the bag 13, as disclosed in the alternative mode, by integrally and overlappedly attaching the first layer 21 of the thermal lining 20 to the outer layer 121 (131) and the second layer 22 to the inner layer 122 (132) respectively to form the construction pocket 201 therebetween.

What is claimed is:

1. A wear, comprising:

an outer layer;

an inner layer overlapped with said outer layer to form a storage compartment;

a thermal lining, which comprises:

a construction pocket shaped and sized to receive in said storage compartment of said wear, wherein said construction pocket, which is detachably disposed in said storage compartment, comprises a first layer made of fabric adapted for water permeating therethrough and a second layer overlappedly attached to said first layer in an edge to edge manner; and a cooling agent, having water absorbing ability, disposed in said construction pocket to form a heat insulation layer between said first and second layers, wherein said cooling agent is adapted for absorbing water and evaporating said water so as to provide a cooling effect of said wear such that only water is allowed to permeate through said first and second layers, wherein said cooling agent is a solid resin disposed in said construction pocket, wherein when said cooling agent is soaked with said water, said water is absorbed by said cooling agent to expand a size thereof and change a phase from solid to liquid so as to form said heat insulation layer, and when an ambient temperature is increased, said heat insulation layer starts to exchange heat energy by evaporating said water in said cooling agent, wherein said first layer is made of fabric having ventilating properties and durability, said first layer being adapted for water permeating into said construction pocket, so as to retain a shape of said cooling agent in said construction pocket after said cooling agent is expanded to form said heat insulation layer; and a plurality of cap leaves attached edge with edge together to form a cap body, wherein said storage compartment is formed at each of said cap leaves, wherein said outer layer is overlappingly attached to said inner layer to form each of said cap leaves, wherein an inlet opening is formed at one edge of said cap leave for communicating said storage compartment with outside so as to receive said thermal lining in said storage compartment, thereby, said inner layer of said wear keeps said water absorbed by said cooling agent within said construction pocket for preventing said water from being permeated through said inner layer of said wear when said wear is worn.

2. A wear, comprising:

an outer layer;

an inner layer overlapped with said outer layer to form a storage compartment;

a thermal lining, which comprises:

a construction pocket shaped and sized to receive in said storage compartment of said wear, wherein said construction pocket comprises a first layer made of fabric adapted for water permeating therethrough and a second layer overlappedly attached to said first layer in an edge to edge manner, wherein said first layer is integrally and overlapped attached to said outer layer and said second layer is integrally and overlapped attached to said inner layer so as to form said construction pocket between said outer and inner layers of said wear; and a cooling agent, having water absorbing ability, disposed in said construction pocket to form a heat insulation layer between said first and second layers, wherein said cooling agent is adapted for absorbing water and evaporating said water so as to provide a cooling effect of said wear such that only water is allowed to permeate through said first and second layers, wherein said cooling agent is a solid resin disposed in said construction pocket, wherein when said cooling agent is soaked with said water, said water is absorbed by said cooling agent to expand a size thereof and change a phase from solid to liquid so as to form said heat insulation layer, and when an ambient temperature is increased, said heat insulation layer starts to exchange heat energy by evaporating said water in said cooling agent, wherein said first layer is made of fabric having ventilating properties and durability, said first layer being adapted for water permeating into said construction pocket, so as to retain a shape of said cooling agent in said, construction pocket after said cooling agent is expanded to form said heat insulation layer; and a plurality of cap leaves attached edge with edge together to form a cap body, wherein said storage compartment is formed at each of said cap leaves, wherein said outer layer is overlappingly attached to said inner layer to form each of said cap leaves, wherein an inlet opening is formed at one edge of said cap leave for communicating said storage compartment with outside so as to receive said thermal lining in said storage compartment, thereby, said inner layer of said wear keeps said water absorbed by said cooling agent within said construction pocket for preventing said water from being permeated through said inner layer of said wear when said wear is worn.

* * * * *